United States Patent [19]

O'Rourke

[11] 4,049,354

[45] Sept. 20, 1977

[54] TOOTHBRUSH WITH DENTIFRICE ATTACHMENT

[76] Inventor: James L. O'Rourke, 6351 Memorial, Detroit, Mich. 48228

[21] Appl. No.: 646,501

[22] Filed: Jan. 9, 1976

Related U.S. Application Data

[63] Continuation-in-part of Ser. No. 506,009, Sept. 16, 1974, Pat. No. 3,936,200.

[51] Int. Cl.[2] ..... B43K 5/14; B43M 11/06

[52] U.S. Cl. ..... 401/134; 401/184; 401/186; 401/287

[58] Field of Search ..... 401/132–135, 401/183–186, 286, 287

[56] References Cited

U.S. PATENT DOCUMENTS

| | | | |
|---|---|---|---|
| 1,065,256 | 6/1913 | La Mar | 401/287 X |
| 1,676,601 | 7/1928 | Cavanaugh | 401/183 |
| 2,729,505 | 1/1956 | Harvey | 401/286 X |
| 2,743,042 | 4/1956 | Burgin | 401/185 X |
| 2,807,818 | 10/1957 | Taylor | 401/135 |
| 2,900,650 | 8/1959 | Riugro | 401/183 |
| 3,319,837 | 5/1967 | Mueller | 401/183 X |
| 3,372,426 | 3/1968 | Schwartzman | 401/183 |

FOREIGN PATENT DOCUMENTS

| | | | |
|---|---|---|---|
| 1,103,009 | 5/1955 | France | 401/135 |
| 49,271 | 11/1938 | France | |

*Primary Examiner*—Stephen C. Pellegrino
*Attorney, Agent, or Firm*—Whittemore, Hulbert & Belknap

[57] ABSTRACT

A toothbrush having a brushing unit and a dentifrice containing cartridge unit. The cartridge unit is shaped to permit it to be comfortably held in the hand and has a squeezable wall for the purpose of expelling dentifrice from the dentifrice-containing chamber therein. A dentifrice passage extending from the dentifrice chamber to the brushing unit is normally closed by a valve which opens by the force of the dentifrice when the cartridge is squeezed. The cartridge has a check valve to allow air to replace used up dentifrice.

2 Claims, 17 Drawing Figures

TOOTHBRUSH WITH DENTIFRICE ATTACHMENT

CROSS-REFERENCE TO RELATED APPLICATION

This application is a continuation-in-part of my prior copending application Ser. No. 509,009, filed Sept. 16, 1974 and now U.S. Pat. No. 3,936,200.

BACKGROUND AND SUMMARY OF THE INVENTION

A primary object of the invention is to provide a toothbrush which has a cartridge for holding dentifrice to be used in the brushing operation. The cartridge, which also may be considered a handle portion, is an elongated unit which fits comfortably in the hand. It has a flexible wall which when squeezed forces dentrifice to the brush head.

Other features of the invention include the provision of valve means, which may be automatic or manual in operation, for opening and closing the passage connecting the dentifrice cartridge and the brush head; a check valve permitting air to fill the space left in the cartridge after some of the dentifrice has been used, which check valve may if desired be formed in a portion of the cap for the fill opening; and a connection between the cartridge or handle portion and the shank of the brushing unit enabling the brushing unit to assume different rotative positions to suit the convenience of the user.

A still further object of the invention is to provide a cartridge unit which is intended for use only one time and then to be thrown away. Such cartridge unit will preferably have a frangible seal to protect the dentifrice contents from contamination which seal is broken by a piercing element when the cartridge is joined to the brushing unit, thereby automatically opening communication between the brushing unit and the dentifrice chamber in the cartridge.

Another object of the invention is to provide a passage from the dentifrices chamber to the brush head terminating in a plurality of tube ends interspersed with the bristles of the brush head.

A search of the prior art has developed the following patents relating to the general subject matter of this invention:

| | | |
|---|---|---|
| Martino | 2,665,442 | Jan. 12, 1954 |
| Longert | 2,888,696 | June 2, 1959 |
| Rivero | 2,900,650 | Aug. 25, 1959 |
| Woodrow | 3,103,935 | Sept. 17, 1963 |
| Cyzer | 3,129,449 | Apr. 21, 1964 |
| Cyzer | 3,217,720 | Nov. 16, 1965 |
| Hendrickson | 3,589,823 | June 29, 1971 |
| Brockman | 3,677,264 | July 18, 1972 |

Figure 1:
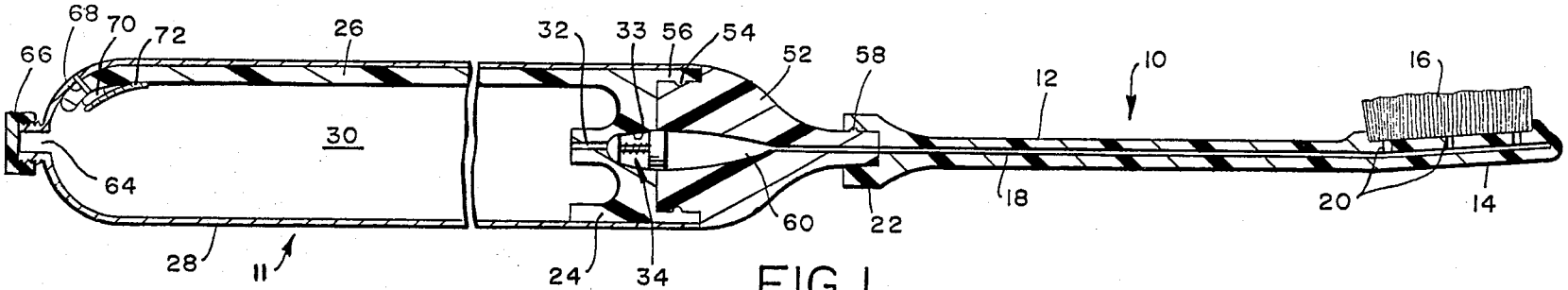
FIG. 1 is a longitudinal sectional view of a toothbrush with dentifrice holder constructed in accordance with my invention.
Figure 2:
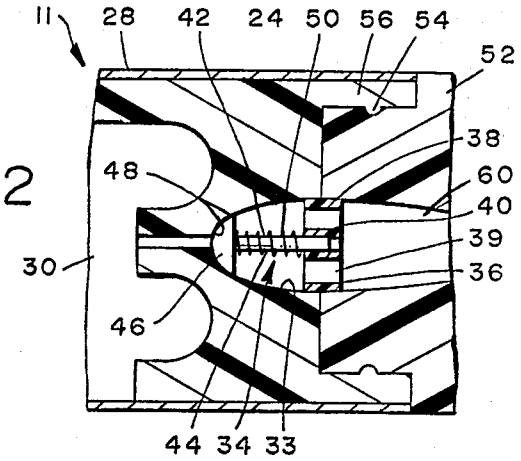
FIG. 2 is an enlarged fragmentary sectional view of a portion of FIG. 1 showing valve mechanism for controlling the passageway from the dentifrice chamber to the brush head.

Referring now more particularly to the drawings and especially to FIGS. 1 to 5 thereof, the toothbrush assembly there shown will be seen to comprise a brushing unit 10 and a cartridge unit 11 which serves also as a handle portion for the assembly.

The brushing unit includes an elongated shank 12 having a brush head at one end provided with a dense multiplicity of brushing bristles 16 projecting from the head laterally with respect to the longitudinal center line of the shank. These bristles may be of the ordinary type used in the standard toothbrush for brushing the teeth.

A central dentifrice passage 18 runs substantially the full length of the shank having ports 20 opening through the surface of the brush head at the base of the bristles to deliver dentifrice thereto. The end of the shank opposite the head 14 is enlarged slightly to provide an internally threaded socket 22. The shank 12 is substantially rigid and is formed of any suitable material such as one of the well known plastics.

The cartridge unit or handle portion 11 is an elongated member having a head 24 at one end and having an integral, relatively rigid spine 26 extending lengthwise thereof from the head. This spine 26 is, in the preferred embodiment, of fairly limited circumferential extent, and is provided to give a degree of strength and rigidity to the handle portion so that the handle portion may be firmly and comfortably held in the hand while the teeth are being brushed. The circumferential extent of the spine however is not critical. The material from which the head 24 and spine 26 are made may be the same as that for the shank 12.

An elongated flexible tube 28 surrounding the head 24 and spine 26 is permanently secured thereto by any suitable means as by a suitable adhesive. This tube defines a chamber 30 for a liquid dentrifrice and may be likened to a bulb on the end of a syringe in that it is self shape-sustaining and will return to the illustrated shape after being squeezed. The tube 28 may be of any shape-sustaining material capable of being squeezed, such for example as rubber or plastic.

The head 24 of the cartridge has a dentifrice passage 32 leading from chamber 30 to a valve chamber 33 housing the valve mechanism 34 for opening and closing the passageway leading from the chamber 30 to the brush head. This valve mechanism 34 includes a valve housing 36 which comprises an outer ring 38 preferably permanently secured within the valve chamber 33, an inner ring or cylinder 40, and radially spaced webs 39 connecting ring 38 and cylinder 48. A valve element 42 has a piston-like valve stem 44 slidable in the cylinder 40 and a piston head 46 adapted to close upon the valve seat 48 formed in the head 24. A compression coil spring 50 compressed between the cylinder 40 and the piston head 46 normally urges the valve element to the closed position shown in FIGS. 1 and 2. When however, the wall of the flexible tube 28 is squeezed, dentifrice in the chamber 30 forces the piston head 46 off its seat to allow dentifrice to flow through the spaces in the valve housing defined by ring 38, cylinder 48 and webs 39 to the brush head 14.

The coupler 52 between the brushing unit 10 and the cartridge unit 11 may be considered as a part of either unit. It has a threaded connection indicated at 54 with an extension 56 of the cartridge head 24, and it also has a threaded connection 58 in the socket 22 of the toothbrush shank 12. A through passage 60 in the coupler 52 extends from the valve chamber 33 in the head 24 of the cartridge unit to the passage 18 in the toothbrush 12 to complete the passageway from the cartridge chamber 30 to the brush head 14 when the parts are assembled as in FIG. 1.

The valve mechanism 34 prior to assembly of the cartridge 11 with the coupler 52, is exposed. To protect the valve mechanism, it may be desirable to provide a removable cover over the projecting edge of the ring 38 of the housing of valve mechanism 34 similar to the cover 102 illustrated in FIG. 8 for the specifically different valve mechanism there shown. This cover would then of course be removed before the cartridge unit is threaded to the coupler 52. Alternatively, the cartridge unit 11 and coupler 52 may be factory assembled and the connection between the parts made permanent for later assembly with the shank 12 of the toothbrush.

The cartridge 11 as shown in FIG. 1 has a fill opening 64 in one end through which liquid dentifrice may be introduced to the chamber 30. A cap 66 threads on the opening to seal the chamber. This fill opening makes it possible to refill the chamber 30 with dentifrice so that the cartridge may be reuseable.

An air intake port 68 extends into the chamber 30 through spine 26 and tube 28. This port is normally closed by a valve element 70 carried by and spring urged to a closed position with respect to the port by a leaf spring 72. The end of the leaf spring 72 opposite valve element 70 is permanently secured to the spine 26. It is obvious that when squeezing pressure is applied to the wall 28 of the tube no dentifrice can escape through port 68 because the internal pressure will reenforce the sealing action of valve element 70. When the tube 28 is released after squeezing however, the greater atmospheric pressure of air outside the tube will force the valve element to open admitting air to the chamber 30 in sufficient quantity to replace the dentifrice dispensed by squeezing and thereby allow the released tube 28 to spring back or return to its natural free state condition shown in FIG. 1.

Figure 4:
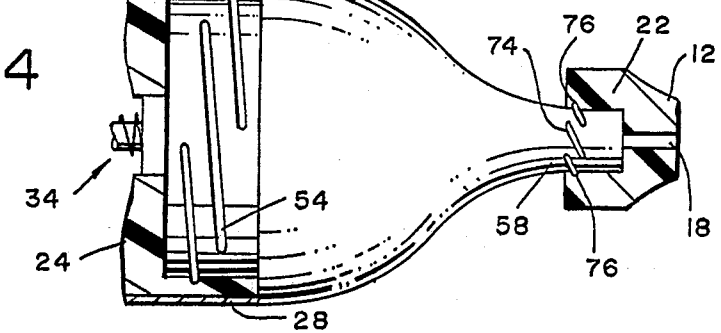
FIG. 4 is an enlargement of another portion of FIG. 1, showing the threaded connections between the parts.
Figure 5:
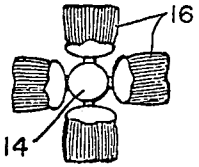
FIG. 5 is an end view of the brush unit as viewed from the right in FIG. 1, showing the brush head in four different alternative positions.

FIG. 4 illustrates the preferred threaded connection 58 between the reduced end of the coupler 52 and the socket 22 of the brush shank 12. This threaded connection preferably consists of four helically disposed thread elements 74 on the reduced end portion of the coupler 52 spaced 90° apart, and four similarly disposed grooves 76 in the socket portion 22 of the shank 12 likewise spaced 90° apart and adapted to mate with the thread elements 74. When the shank 12 is threaded tight on the coupler 52, the reduced end of the coupler will abut the bottom of the socket 22 and the brush head 14 will project laterally in one of the four positions illustrated in FIG. 5 depending upon which of the four thread elements 74 engages which of the thread grooves 76. By starting the threaded connection 58 so that different threads and grooves engage one another, the threaded connection when completed will result in the brush head 14 projecting laterally in any one of the four positions shown in FIG. 5.

Figure 3:
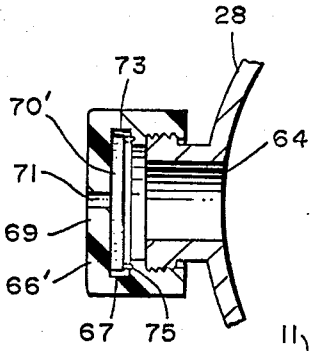
FIG. 3 is an enlarged fragmentary sectional view of another portion of FIG. 1 showing the fill opening and closure cap therefor.

FIG. 3 illustrates a modified cap 66' for the fill opening 64. This cap threads on the fill opening in the same manner as cap 66. However, the check valve for admitting air to the chamber 30 when squeezing pressure is released is incorporated in the cap. Such check valve structure includes the valve disc 70' which lies within the bottom of the cap in an enlarged chamber 67. The valve disc is held lightly against the base 69 of the cap by the circumferentially spaced spring elements 75 to close the air inlet 71. When internal pressure exists in the chamber 30 due to squeezing of the cartridge, the valve disc is forced by internal pressure against the base 69 of the cap to close the air inlet 71 with even greater force. Reduction in internal cartridge pressure as when the squeezing pressure is released, causes the valve disc 70' to move away from and open the inlet 71 against the action of spring elements 75. The spring elements 75 act very lightly upon the valve disc so that their spring pressure is easily overcome by the differential air pressure when the cartridge is released after squeezing.

FIGS. 6–9 illustrate a valve mechanism 80 of modified construction. The head 24' of the cartridge unit 11' is of slightly different form as will be apparent from a comparison of FIGS. 2 and 6. Otherwise, cartridge unit 11' may be the same as that previously described. Such head 24' has a passage 32' and a valve seat 48' serving the same purposes as the corresponding portions of the cartridge head 24 in FIGS. 1 and 2. The seat 48' is normally closed by a valve element 82. The valve element 82 is permanently secured to an elongated leaf spring 84 about midway between the ends thereof. Pins 86 projecting from the end portions of the leaf spring slide in slots 88 formed in the plate 90 of the housing 92. The plate 90 extends across and is integrally joined to a housing ring 94 which is permanently secured in the valve chamber 96 of the head 24'. A cylinder 98 mounted on the plate 90 guides the sliding movement of plunger 100 on the back of the leaf spring 94.

Figure 6:
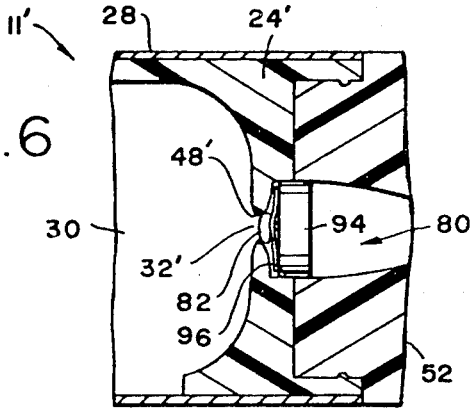
FIG. 6 is a view similar to FIG. 2 but showing a modification.
Figure 8:
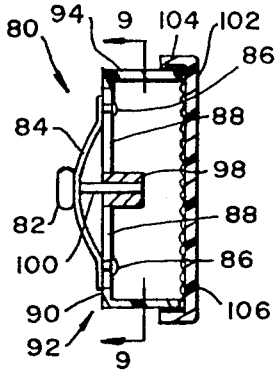
FIG. 8 is a sectional view of the valve mechanism.
Figure 9:
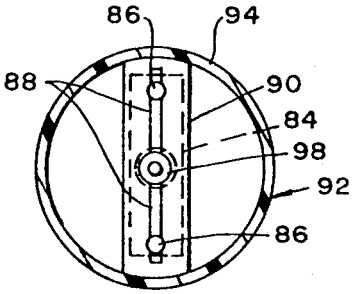
FIG. 9 is a sectional view taken on the line 9—9 in FIG. 8.

The leaf spring 84 normally assumes the FIG. 8 position and thus urges the valve element 82 to the closed position against seat 48' shown in FIG. 6, thus closing the outlet passage from chamber 30. When however, the wall 28 of the cartridge is squeezed to expel dentifrice, the internal force unseats the valve element 82. Unseating of the valve element is accompanied by a flattening of spring 84 and sliding of pins 86 in slots 88. Dentifrice can flow past the unseated valve element 82 between the ring 94 and plate 90 of the valve housing and through the passage in the toothbrush shank to the head. When the squeezing pressure is released the valve element 82 returns by spring pressure to the FIG. 6 position.

Before the cartridge 11' is assembled with the coupler 52, the valve mechanism 80 needs to be protected and for that purpose a disc-shaped cover 102 is provided having a peripheral flange 104 which extends over the ring 94 of the valve housing with a friction fit to close the back of the valve housing and protect the cartridge from contamination. A screen 106 under the closure 102 is also provided which may remain over the valve housing temporarily after the cover is removed to provide further protection to the elements of the valve mechanism.

Figure 10:
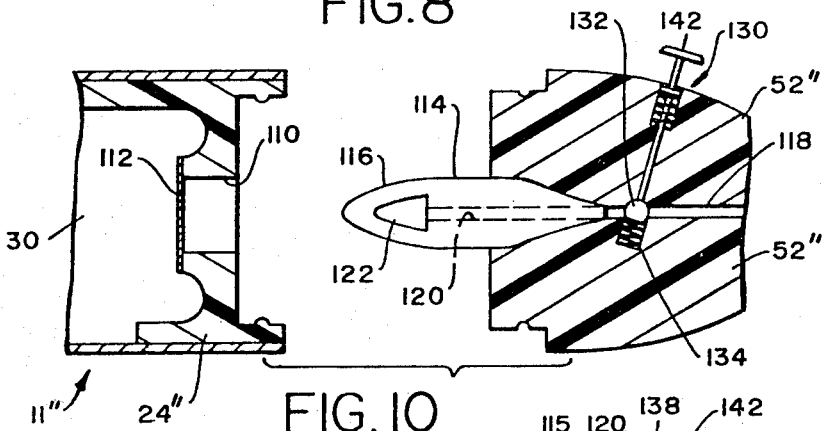
FIG. 10 illustrates a further modification with the parts separated.
Figure 11:
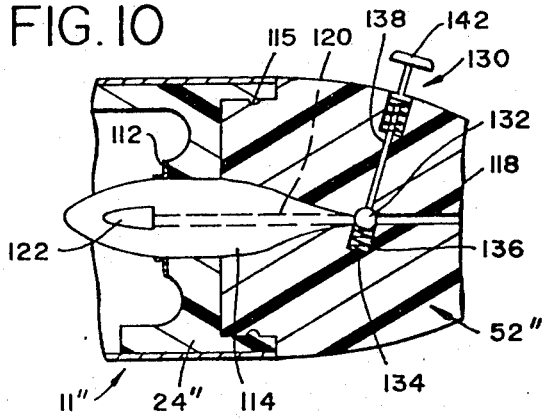
FIG. 11 shows the parts of FIG. 10 assembled.

FIGS. 10 and 11 illustrate a modification of the invention in which the cartridge 11" has a head 24" of slightly different configuration provided with a cylindrical passage or outlet port 110 normally closed by a frangible film 112 of plastic or like material across and closing the outlet 110. The cartridge 11" is intended as a throw-away cartridge which is used only once. Hence it will not require a fill opening but should have a check valve which may be of the type shown in FIG. 1. Otherwise, the cartridge 11" of FIGS. 10 and 11 is like that of FIG. 1.

The coupler 52" has a piercing element 114 which projects from the coupler toward the cartridge. The piercing element 114 is cylindrical in form and of the same diameter as the passage 110. It has a tapered nose 116. When the coupler is screwed into the head 24" of cartridge 11" to form the threaded connection 115 the piercing element 114 pierces the frangible seal 112.

The coupler 52" has a passage 118 which leads to the passage in the toothbrush of the same construction and secured thereto in the same manner as in FIGS. 1–5. The piercing element has a passage extension 120 terminating in open ports 122 in the nose of the piercing element. When the parts are assembled as in FIG. 11, the ports 122 are disposed within the chamber 30 of the cartridge to provide a complete passageway to the shank of the toothbrush. Any number of ports 22, for example three circumferentially spaced, may be provided in the nose of the piercing element 114.

A manually operable valve mechanism 130 is provided for the coupler 52". This mechanism includes a ball type valve 132 disposed at least partially in a coupler socket 134. A compression coil spring 136 in the socket normally urges the ball 132 to the closed position with respect to passage 118 shown in FIGS. 10–12. An elongated pin 138 is reciprocable in a passage 140 in the coupler. When this pin is depressed by thumb pressure against the pin head 142, its end presses ball 132 deeper into the socket 134 against the action of spring 136 to open the passage. A compression coil spring 144 in socket 150 normally urges the pin 138 to the retracted position shown in the drawings. This compression spring 142 bears against the bottom of the socket 150 and against a collar 152 secured to the pin 138.

Figure 12:
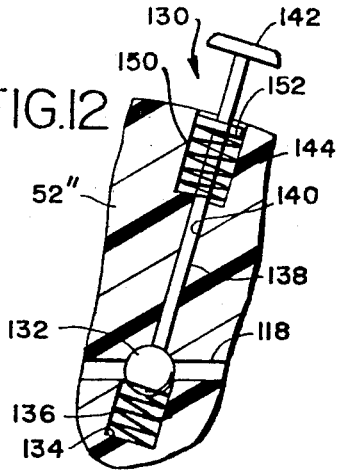
FIG. 12 is an enlargement of the valve mechanism shown in FIGS. 10 and 11.
Figure 7:
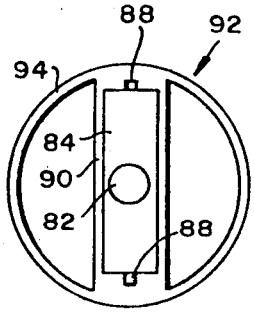
FIG. 7 is a plan view of the valve mechanism shown in FIG. 6 as viewed from the left.

One method of manufacturing the coupler 52" in a manner permitting the easy assembly of the parts of the valve mechanism 130 is to mold the coupler body 52" in two longitudinal halves, the split between the halves occurring in the plane of the section shown in FIGS. 10–12, assembling the ball and spring together and then securing the two halves together. This is just one way in which the coupler may be constructed so as to permit assembly of the valve mechanism 130, it being understood that the invention is not in any way limited to the method of constructing the coupler.

Figure 13:
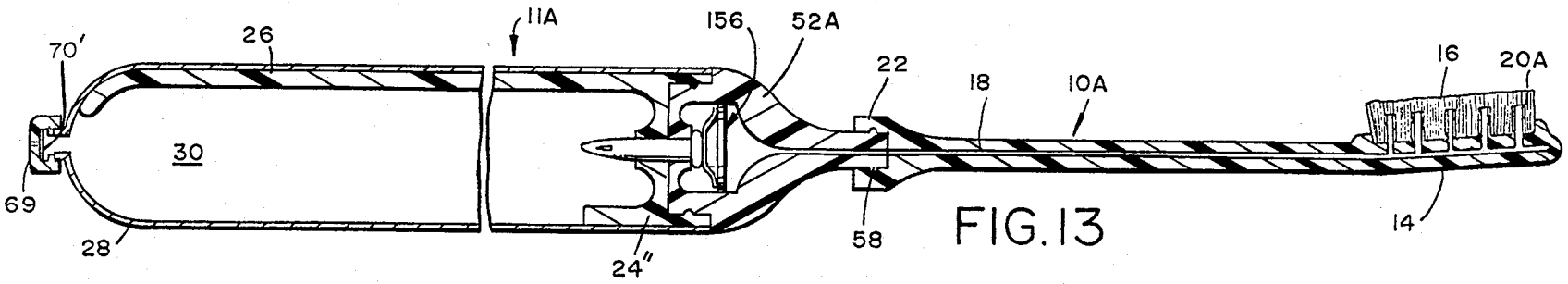
FIG. 13 is a longitudinal sectional view of a toothbrush of modified construction.

FIG. 13 illustrates a toothbrush assembly of modified construction. The cartridge 11A is like the cartridge 11 of FIG. 1 except that the check valve for allowing air to enter the chamber 30 is in the fill opening cap as in the FIG. 3 modification, and except further that the head portion 24" is formed like that in the modification of FIGS. 11 and 12. Parts of the cartridge 11A corresponding to those previously described are identified by the same characters of reference.

The coupler 52A is like the coupler 52" in FIGS. 10 and 11 in that it has a piercing element 114, the parts of which are identified by the same reference characters as previously employed. The coupler 52A differs from the coupler 52" in that its through passage 118A has an enlarged valve chamber 154 in which is disposed a valve mechanism 156. The valve mechanism 156 is similar to the valve mechanism 80 previously described in connection with FIGS. 6–9. Such valve mechanism 156 comprises a valve element 160 which normally is held seated against the end of the piercing element 114. It will be noted that the end of the piercing element opposite its tapered end is exposed to the valve chamber 154. The valve element 160 is permanently secured to an elongated leaf spring 162 about midway between the ends thereof. Pins 164 project from the end portions of the leaf spring and slide in slots 166 formed in a vertical plate 168. The ends of this plate are permanently secured to opposite walls of the chamber 154, leaving space on opposite sides of the plate for the passage of dentifrice when the valve mechanism opens. A cylinder 170 mounted on the plate 168 guides the sliding movement of the plunger 100 on the back of the leaf spring.

Figure 14:
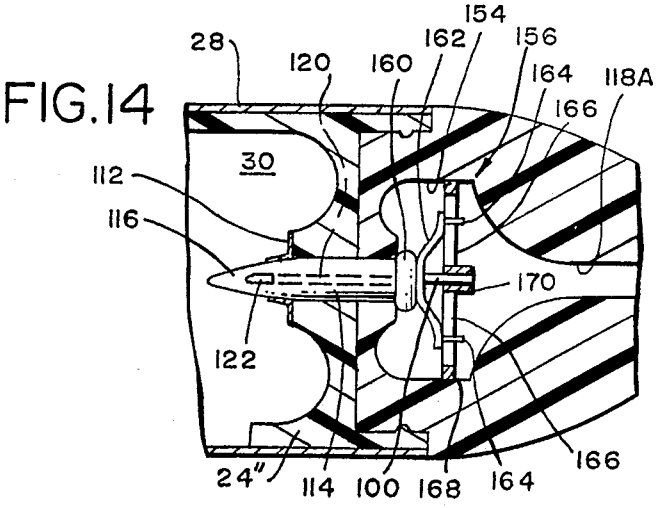
FIG. 14 is an enlarged fragmentary view of a portion of FIG. 13.
Figure 15:
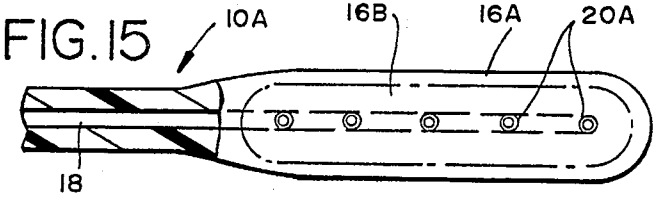
FIG. 15 is a fragmentary view of the brush head shown in FIG. 13 as viewed from above.
Figure 16:
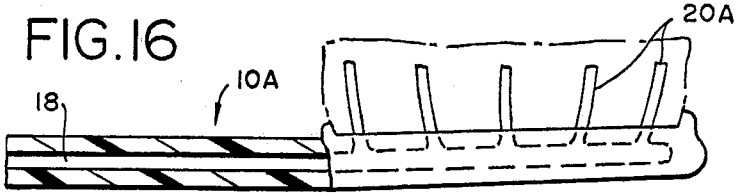
FIG. 16 is a side view of the brush head.

The leaf spring 162 normally assumes the position shown in FIGS. 13 and 14 holding the valve element 160 in closed position against the end of passage 120 in piercing element 114 and thus closing the outlet from the chamber 30. When however, the wall 28 of the cartridge is squeezed to expel dentifrice, the internal force unseats the valve element 160 in the same manner as described above in connection with FIGS. 6–9. Dentifrice can flow past the unseated valve element through the coupler and through the passage of the toothbrush shank to the head. When squeezing pressure is released the valve element 160 returns by spring pressure to the illustrated position.

The brushing unit 10A is the same as that illustrated in FIG. 1 except that the ports 20 in FIG. 1 for delivering dentifrice from the shank passage 18 to the bristles are replaced by tubes 20A. These tubes 20A extend from the passage 18 and are parallel to and interspersed among the bristles 16 of the brush head 14. The dentifrice forced from the chamber 30 is thus discharged from the open outer ends of the tubes 20A near the brushing ends of the bristles.

Preferably the outer ends of the peripheral bristles 16A project farther outward from the base of head 14 than the bristles 16B surrounded by the bristles 16A. In other words, the tops of the central bristles 16B are recessed slightly with respect to the tops of surrounding or peripheral bristles 16A. It is also preferred that the tops or discharge ends of the tubes 20A terminate in amongst the central bristles 16B substantially flush with the tops or outer ends of such bristles 16B. Accordingly, the dentifrice discharged from the tubes 20A will be confined to some extent within the recessed area at the top of the bristles surrounded by those peripheral bristles identified as 16A.

Figure 17:
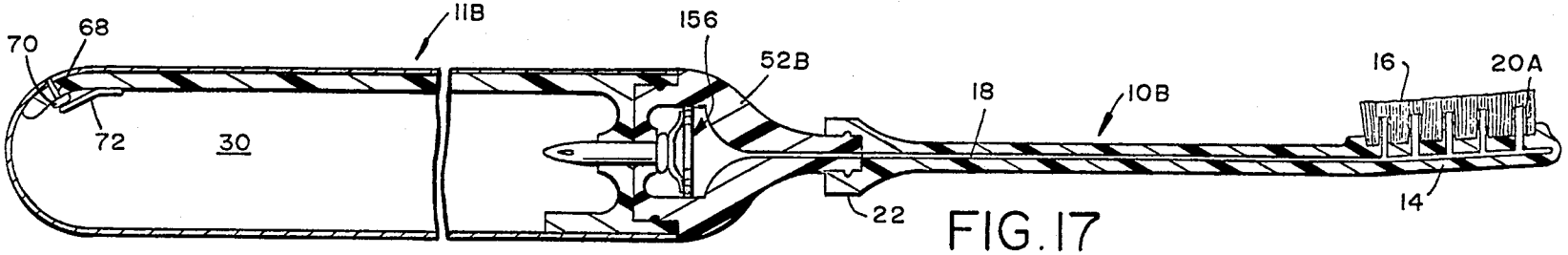
FIG.17 is a longitudinal sectional view of still another modification.

FIG. 17 shows a further modification of the invention in which the cartridge 11B is like the cartridge 11A except that no fill opening is provided and except further that a separate check valve 170 and inlet port 68 for the introduction of air to the chamber 30 when squeezing pressure is released are provided. This check valve structure including the leaf spring 72 is substantially like that shown in FIG. 1 The cartridge unit 11B is intended as a throw-away item. The coupler 52B and brush unit 10B are the same as the corresponding parts shown in FIGS. 13–16.

What I claim as my invention is:

1. A toothbrush comprising a brushing unit, an elongated cartridge unit having a chamber adapted to contain a dentifrice, said cartridge unit having a head at one end and an elongated spine along one side of said chamber to facilitate gripping said cartridge unit, said chamber being defined at least in part by squeezable wall, said brushing unit including a shank portion having a head at one end provided with bristles, a coupler at the other end of said shank portion releasably connected to said one end of said cartridge unit, passage means from said chamber including passages through said one end of said cartridge unit, said coupler, said shank portion and said head to convey dentifrice to said bristles when forced from said chamber by the squeezing of said wall, and a check valve in said spine for said chamber adapted to close when said wall is squeezed and to open and admit air to said chamber when said wall is released after squeezing, said check valve being located in a wall of said cartridge unit and when open providing direct communication between the dentifrice in said chamber and the ambient air surrounding said cartridge unit through said spine.

2. The toothbrush defined in claim 1, wherein said one end of said cartridge unit has a frangible seal across the passage therethrough initially closing said passage means, and said coupler has a piercing element adapted to pierce said seal when said coupler and cartridge unit are connected together as aforesaid to open said passage means.

* * * * *